United States Patent [19]

Yogo

[11] 4,391,116

[45] Jul. 5, 1983

[54] LACE BENDING APPARATUS

[76] Inventor: Teruaki Yogo, Kabushikikaisha Chuodenkiseisakusho 4423 aza-Johnoh, Ohaza-Ohmori, Moriyama-ku, Nagoya-shi, Japan

[21] Appl. No.: 212,184

[22] Filed: Dec. 2, 1980

[30] Foreign Application Priority Data

Dec. 3, 1979 [JP] Japan ..... 54-157225
Sep. 1, 1980 [JP] Japan ..... 55-120944

[51] Int. Cl.[3] ..... B21B 15/00; B21B 39/00

[52] U.S. Cl. ..... 72/168; 72/177; 72/166

[58] Field of Search ..... 72/7, 21, 27, 166, 168, 72/177, 299, 311, 135, 138

[56] References Cited

U.S. PATENT DOCUMENTS 2,150,731 3/1939 Smith ..... 72/168
3,388,573 6/1968 Presley, Jr. ..... 72/7
4,061,005 12/1977 Kawanami et al. ..... 72/166
4,080,815 3/1978 Foster ..... 72/168

FOREIGN PATENT DOCUMENTS 50-7549 3/1975 Japan ..... 72/166
204873 of 0000 U.S.S.R. ..... 72/305
510292 5/1976 U.S.S.R. ..... 72/168

*Primary Examiner*—Lowell A. Larson
*Attorney, Agent, or Firm*—William A. Drucker

[57] ABSTRACT

Apparatus capable of bending laces in a continuous manner. A lace material is supplied from a material feed device and allowed to pass through a fixed guide roller element for locating the material and a movable guide roller element for bending the material. The guide roller element for bending the material can move in directions perpendicular to the direction of supply of the material in relation to the fixed guide roller element for locating the material. When passing through these guide roller elements, the material can be bent in accordance with the speed of supply or feed of the material and the moving amount of the movable guide roller element so that desired radii of curvature are given to the material.

5 Claims, 20 Drawing Figures

LACE BENDING APPARATUS

BACKGROUND OF THE INVENTION

1. Field of the Invention

This invention relates to an apparatus for bending laces consisting of band-shaped materials having a variety of cross sections, such as ones used as window frames of an automobile.

2. Description of the Prior Art

As shown in FIG. 20, the above-mentioned type of lace has heretofore been bent by the use of clamps 191,191 which hold the ends of a material 190 cut to a desired length and a metallic mold 193 which is supported by guide lods 192,192 and pressed against the material 190 by the action of a cylinder 194. However, such conventional method lacks efficiency because of intermittent bending operation. The conventional method is also defective in that the need to leave margins 195,195 of the material not grasped by the clamps 191,191 results in a waste of material, it requires much labor and delicate job to obtain a desired product, and it requires much labor to produce the metallic mold 193 suited for making a desired bending.

SUMMARY OF THE INVENTION

An object of this invention is to provide a lace bending apparatus which is capable of bending materials efficiently while supplying them in a continuous manner.

Another object of this invention is to provide a lace bending apparatus which makes it possible not only to improve the efficiency of the bending operation, but to prevent materials from being wasted in the production of articles.

A further object of this invention is to provide a lace bending apparatus which can bend materials without using any metallic mold.

According to the invention, a material is fed from a material feed device and allowed to pass through the first guide roller element (for locating the material) and the second guide roller element (for bending the material). The material is bent by the second guide roller element being moved in relation to the first guide roller element. Therefore, the bending operation of materials can be made in a continuous manner while the materials are continuously supplied. In addition, a desired bending can be effected to materials without using any metallic mold.

Other objects and advantages of the invention will become apparent during the following explanation of the accompanying drawings.

DESCRIPTION OF THE PREFERRED EMBODIMENTS

Figure 1:
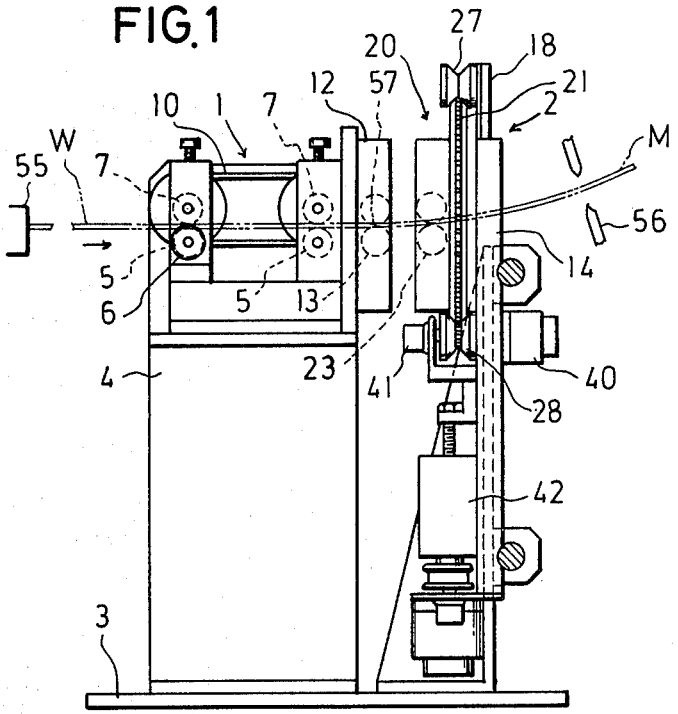
FIG. 1 is a partially-broken side elevation of the apparatus according to the invention.
Figure 2:
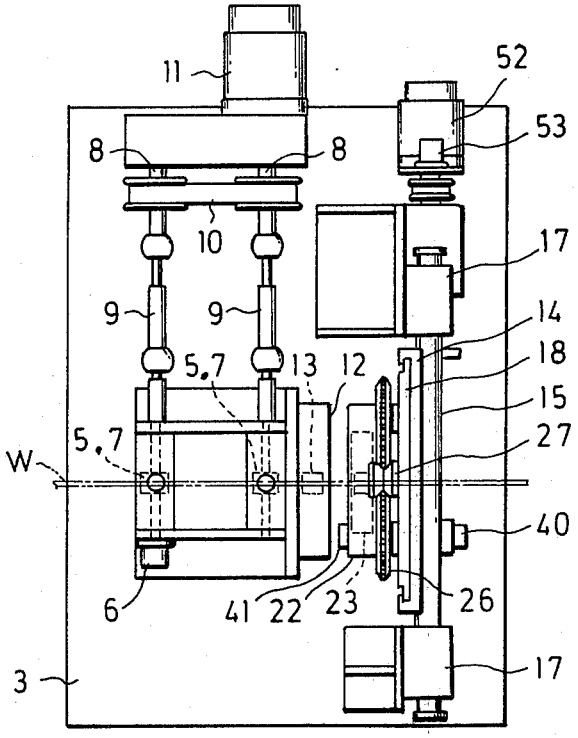
FIG. 2 is a plan view of the apparatus of FIG. 1.

Referring now to FIGS. 1 to 10, one embodiment of the invention comprises a material feed device 1 and a movable guide roller device 2. The material feed device 1 includes a framework 4 installed on a base 3. The framework 4, at the upper portion thereof, includes two support rollers 5,5 which are arranged at the right and left portions (in FIG. 1), respectively, of the framework 4 and extend in parallel with the guide roller device 2. A pulse oscillator 6 as feed amount detector is attached to the framework 4 and connected to one end of the support roller 5 positioned at the left side (in FIG. 1) of the framework 4. Two feed rollers 7,7 are provided immediately above the support rollers 5,5, respectively, in a vertically movable manner. The feed rollers 7,7 are connected to axles 8,8 through universal joints 9,9, respectively. Two wheels are provided on the axles 8,8, respectively, so as to turn thereon, and connected to each other by a transmission belt 10. The axle 8 positioned at the right side (in FIGS. 1 and 2) of the feed device 1 is connected to a feed motor 11 which is adapted to rotate the feed rollers 7,7 counterclockwise (in FIG. 1) at the same speed so that a material W is caused to move backward between the upper and lower rollers 7,7 and 5,5. A guide box 12 is attached to the rear side (right side in FIGS. 1 and 2) of the framework 4 in a removable manner and contains the first guide roller element 13 which is provided for locating the material W fed through the framework 4 and has the same shape as the second guide roller element 23 for bending the material W.

The movable guide roller device 2 is located adjacent to the material feed device 1. This device 2 comprises a support device and the second guide roller element 23 for bending the material W fed through the first guide roller element 13. The support device includes frames 16,16 at the left and right sides (in FIG. 3) of the guide roller device 2 and movable elements attached to the frames 16,16. Each of the frames 16,16 includes upper and lower receiving elements 17,17 to receive upper and lower horizontal guide rods 15,15 (in a slidable manner) which support the first slide 14 in a horizontally movable (to the right and left in FIG. 3) manner. The first slide 14 supports the second slide 18 in a vertically movable manner. The first and second slides 14,18 constitute a slide mechanism 19. A guide roller mechanism 20 is attached to the second slide 18.

Figure 3:
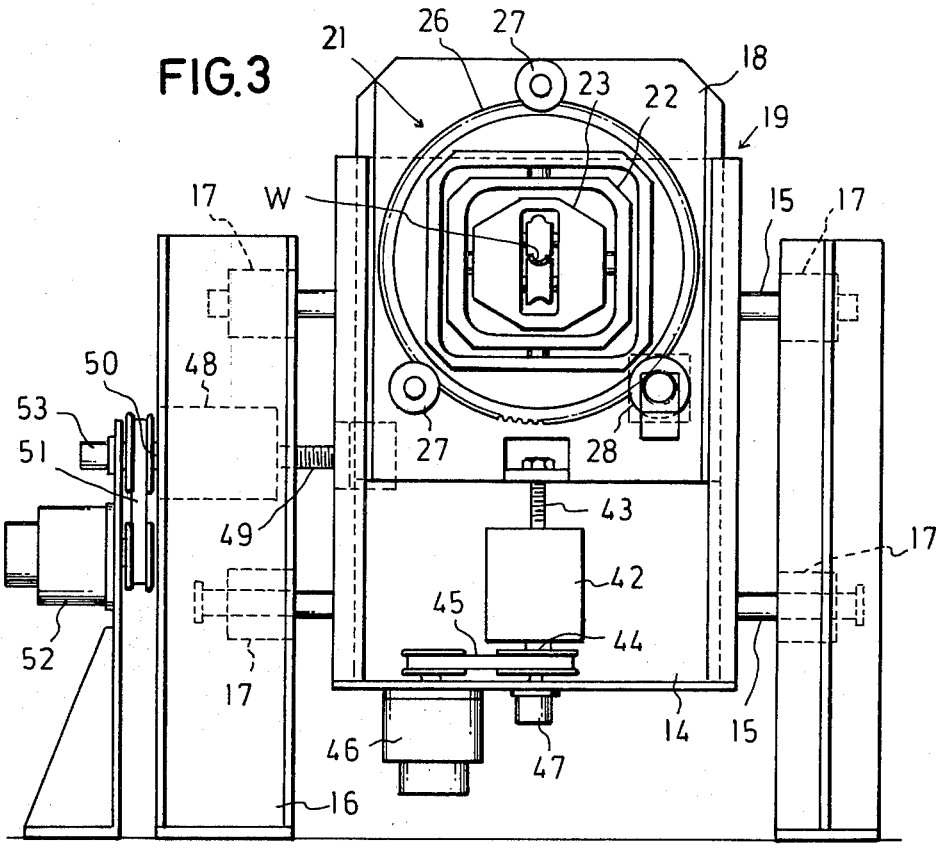
FIG. 3 is an enlarged elevational view of a movable guide roller device.
Figure 4:
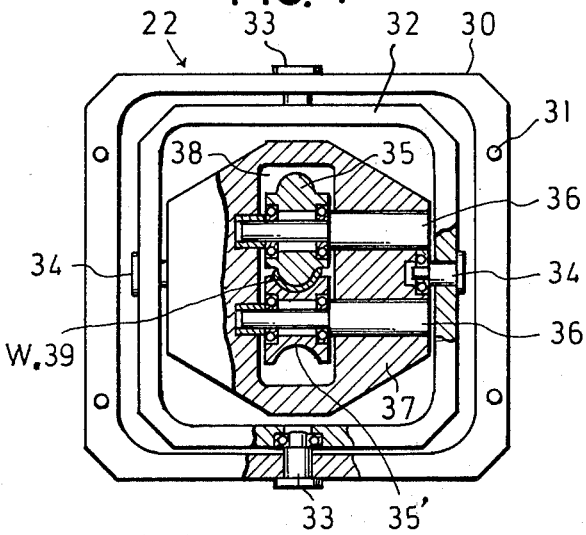
FIG. 4 is an enlarged cross sectional view showing the relationship between guide roller elements and a universal joint mechanism.
Figure 5:
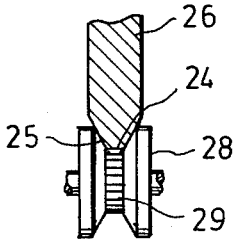
FIG. 5 is an enlarged cross sectional view showing the relationship between a rotary wheel and a driving roller.
Figure 6:
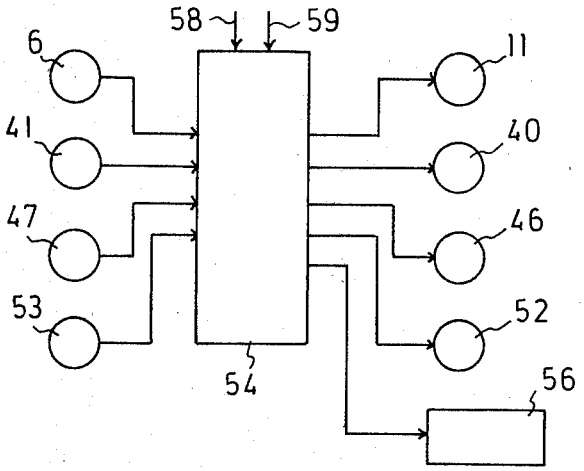
FIG. 6 shows an electric system used for the apparatus of FIG. 1.
Figure 7:
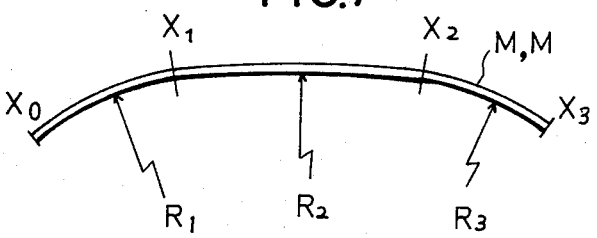
FIG. 7 shows a product bent by using the apparatus of FIG. 1.
Figure 8:
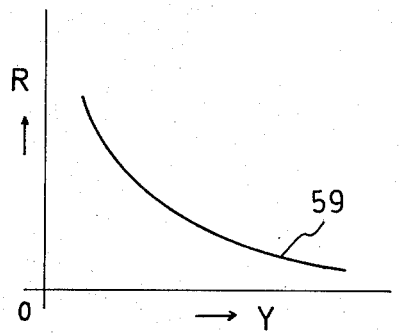
FIG. 8 is a graph showing the relationship between the radius of curvature of materials and the removal amount of slides.
Figure 9:
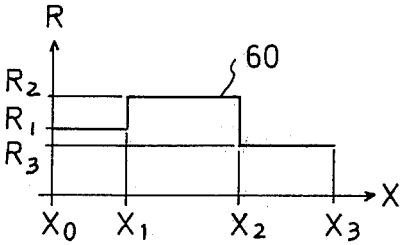
FIG. 9 shows a size program.
Figure 10:
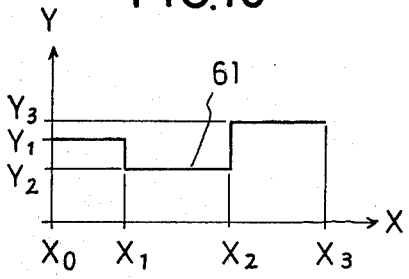
FIG. 10 shows a command program.

The guide roller mechanism 20 includes the second guide roller element 23 installed at the center of a rotary mechanism 21 by means of a universal joint mechanism 22. The rotary mechanism 21 includes a rotary wheel 26 which has a periphery 25 provided with teeth 24 and shaped like a trapezoid (FIG. 5). As shown in FIG. 3, the rotary wheel 26 is supported at the periphery 25 thereof by a plurality of rollers 27,27 located at the front side of the first slide 14 and having V-channels and a driving roller 28 having V-channels. The driving roller 28 has a pinion portion 29 formed by the bottoms of the V-channels thereof and adapted to engage with the teeth 24 of the rotary wheel 26, and causes the wheel 26 to rotate. The universal joint mechanism 22 comprises an outer frame 30 attached with the same center as the rotary wheel 26 in front of the wheel 26 by a plurality of screws 31 and an inner frame 32 attached to the outer 30 by upper and lower vertically-extending pins 33,33 which intersect the axis of the rotary wheel 26 by an imaginery line connecting the pins 33,33. Pins 34,34 extend horizontally through the inner frame 32 at the right and left sides of the frame 32, and fixes the second guide roller element 23 within the inner frame 32.

The second guide roller element 23 includes a roller case 37 which is provided with a cavity 38 located at the center of the case 37. The roller case 37 also includes upper and lower shafts 36,36 supporting a pair of upper and lower rollers 35,35', respectively, in the cavity 38. A space 39 is provided between the upper and lower rollers 35,35', and has a similar shape to the cross section of the material W to be bent. The first guide roller element 13 has a similar shape to the second guide roller element 23. The roller case 37 of the second guide roller element 23 is attached to the inner frame 32 of the universal joint mechanism 22 by means of the pins 34. The center of the space 39 between the upper and lower rollers 35,35', is located at the intersection of two imaginery lines connecting the upper and lower pins 33,33 and right and left pins 34,34, respectively.

An electric motor 40 for rotating the rotary wheel 26 is attached to the second slide 18, and connected to one end of a shaft of the driving roller 28. The electric motor 40 and driving roller 28 constitute a rotary-wheel driving element. A pulse oscillator 41 is also attached to the second slide 18, and connected to the other end of the shaft of the driving roller 28. A ball-screw mechanism 42 is provided in the first slide 14, and has a vertically extending screw 43 connected to the lower end of the second slide 18 and an input shaft 44 connected to a second-slide driving motor 46 attached to the first slide 14 by means of a belt transmission mechanism 45. A pulse oscillator 47 is also attached to the first slide 14, and connected to the input shaft 44 of the ball-screw mechanism 42. The ball-screw mechanism 42, belt transmission mechanism 45 and second-slide driving motor 46 constitute a second-slide driving element. Another ball-screw mechanism 48 is provided in the left frame 16 (in FIG. 3), and has a horizontally extending screw 49 connected to the first slide 14 and an input shaft 50 connected to a first-slide driving motor 52 (also attached to the left frame 16) by means of a belt transmission mechanism 51. A pulse oscillator 53 is also attached to the left frame 16, and connected to the input shaft 53 of the ball-screw mechanism 48. The ball-screw mechanism 48, belt transmission mechanism 51 and first-slide driving motor 52 constitute a first-sliding driving element. The motors 11, 40, 46 and 52 are connected to the output side of a computer 54, while the pulse oscillators 6, 41, 47 and 53 are connected to the input side of the computer 54. In FIG. 1, numerals 55 and 56 designate a forming machine provided in front of the material feed device 1 and a cutter provided to the rear of the movable guide roller device 2, respectively. The forming machine 55 and cutter 56 are connected to the output side of the computer 54.

Explanation is now given of the operation of the bending apparatus. The material W having a desired cross section is produced in a linear manner by the forming machine 55. The material W is caused to enter the material feed device 1, moved backward by and between the feed rollers 7,7 and support rollers 5,5, and caused to pass through a space 57 between upper and lower rollers of the first guide roller element 13 and the space 39 between the upper and lower rollers 35,35' of the second guide roller element 23. In this condition (i.e., the material W being located through between the feed rollers 7,7 and support rollers 5,5 and through the spaces 57 and 39 of the two guide roller elements 13 and 23), the computer 54 is operated to drive the motor 11. The operation of the motor 11 causes the right axle 8 (in FIG. 2) connected to the motor 11 to rotate, and this rotation is transmitted to the left axle 8 (in FIG. 2) by means of the transmission belt 10. The rotations of the axles 8,8 in turn cause the feed rollers 7,7 to rotate counterclockwise (in FIG. 1) by way of the universal joints 9,9. The rotations of the feed rollers 7,7 cause the material W to move backward, and also cause the support rollers 5,5 to rotate. The pulse oscillator 6 connected to the left support roller 5 (in FIG. 1) detects the amount of feed of the material W from the rotational frequency of the left support roller 5, and gives the values of the feed amount into the computer 54. A size program 58 (which will be explained hereinafter) of a product M to be obtained has previously been supplied into a memory of the computer 54, which makes command signals based on the size program 58 in accordance with the values of the material feed amount. Given such command signals, the motors 40, 46 and 52 operate in accordance with the values of the material feed amount. The operations of the motors 40, 46 and 52 are fed back to the computer 54 by means of associated pulse oscillators 41, 47 and 53, and the feedback signals give predetermined amounts of operation to the motors 40, 46 and 52. A predetermined amount of operation of the motor 46 is transmitted upwardly through the belt transmission mechanism 45 and ball-screw mechanism 42, and causes the second slide 18 to move in a vertical direction. This vertical movement of the second slide 18, through the rotary wheel 26 and universal joint mechanism 22 connected to the rotary wheel 26, in turn causes the second guide roller element 23 to move in a vertical direction by the predetermined amount in relation to the (fixed) first guide roller element 13. Similarly, a predetermined amount of operation of the motor 52 is transmitted through the belt transmission mechanism 51 and ball-screw mechanism 48, and causes the first slide 14 to move to the right or left (in FIG. 3) by the predetermined amount. This horizontal movement of the first slide 14, through the second slide 18 supported by the first slide 14, consequently the rotary wheel 26 and universal joint mechanism 22, in turn causes the second guide roller element 23 to move to the right or left by the predetermined amount. A predetermined amount of operation of the motor 40, through the driving roller 28, rotary wheel 26 and universal joint mechanism 22, causes the second guide roller element 23 to turn with the axis of the rotary wheel 26 as a center. These vertical, horizontal (to the right and left in FIG. 3) and turning movements of the second guide roller element 23 cause the material W (while being moved backwardly) to be bent in accordance with the predetermined radius of curvature and twisted as required between the (fixed) first guide roller element 13 and the (movable) second guide roller element 23.

The second guide roller element 23 can be freely inclined backward and forward (to the right and left in FIG. 1) by the pins 33,34 of the universal joint mechanism 22 so that the material W controls the posture of the second guide roller element 23 automatically in the moving direction of the material W when passing through the space 39 between the rollers 35 and 35' of the element 23. Therefore, the material W can pass smoothly through the space 39. When the material W passing through the space 39 has reached the predetermined length, a signal from the pulse oscillator 6 gives a predetermined value, according to which the computer 54 gives an operation command to the cutter 56. The material W is cut by the cutter 56 to produce a lace product M.

Explanation is now given of the size program 58 fed into the computer 54. For simplicity of explanation, it is assumed that the product M to be obtained from the material W must be given the curvature radii of $R_1$, $R_2$ and $R_3$ between values $X_0$ and $X_1$, $X_1$ and $X_2$, and $X_2$ and $X_3$, respectively, in the lengthwise direction of the material W. The material W fed from the material feed device 1 and first guide roller element 13, when passing through the space 39 in the second guide roller element 23, is bent on trial by moving the first slide 14 gradually by appropriate values. By this trial bending, curve data 59 (FIG. 8) is obtained as to the correlation between the curvature radius R of the material W and the moving amount Y of the first slide 14. This data 59 is fed into the computer 54 as a preparation for actual production. Another preparation for production is made by feeding into the computer 54 a program 60 (FIG. 9) (as a size program 58) as to the correlation between the feed amount X and curvature radius R of the material W. The complete preparation for obtaining the product M is thus made. That is, after these preparations, the computer 54 is in a position to give a X-Y program 61 (FIG. 10) comprising converted curvature radii $R_1$, $R_2$ and $R_3$ and moving amounts (of the first slide 14) $Y_1$, $Y_2$ and $Y_3$ as command signals so that the material W can be bent in the manner previously mentioned.

Figure 11:
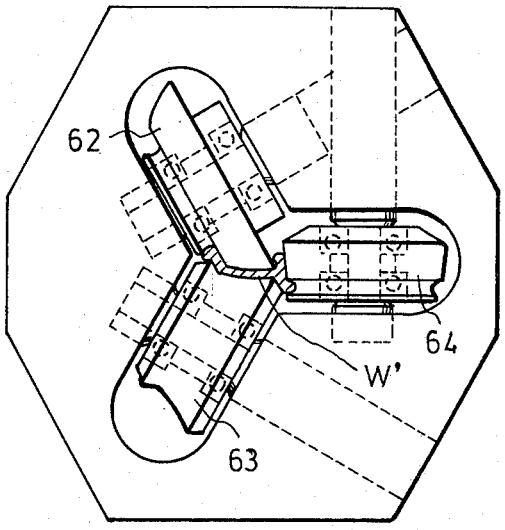
FIG. 11 shows an enlarged elevational view of a further example of a guide roller element.

Each of the guide roller elements 13 and 23 may be composed of three rollers 62, 63 and 64 which are in accordance with the shape of the cross section of the material W, as shown in FIG. 11. The operation control by the computer 54 using the pulse oscillators may be of the open-loop type instead of the closed-loop type explained hereinbefore.

Referring now to FIGS. 12 to 19, another embodiment of the invention comprises a material feed device 101 and a movable guide roller device 102. The material feed device 101 includes a framework 104 installed on a base 103. The framework 104, at the upper portion thereof, includes two support rollers 105,105 which are arranged at the right and left sides (in FIG. 12), respectively, of the framework 104 and extend in parallel with the guide roller device 102. Two feed rollers 106,106 are provided immediately above the support rollers 105,105, respectively, in a vertically movable manner. The feed rollers 106,106 are connected to bevel gears 107,107 through universal joints 108,108, respectively. The bevel gears 107,107 are engaged with bevel gears 110,110 provided on an intermediate shaft 109 connected to a feed motor 111 which is adapted to rotate the feed rollers 106,106 counterclockwise (in FIG. 12) at the same speed so that a material W is caused to move backward between the upper and lower rollers 105,105 and 106,106. A guide box 112 is attached to the rear side (right side in FIG. 12) of the framework 104 in a removable manner and contains the first guide roller element 113 which is provided for locating the material W fed through the framework 104 and has the same shape as the second guide roller element 123 for bending the material W.

The movable guide roller device 102 is located adjacent to the material feed device 101. This device 102 comprises a support device and the second guide roller element 123 for bending the material W fed through the first guide roller element 113. The support device includes frames 116, 116 at the left and right sides (in FIG. 14) of the guide roller device 102. Each of the frames 116,116 includes upper and lower receiving elements 117,117 to receive upper and lower horizontal guide rods 115,115 (in a slidable manner) which support the first slide 114 in a horizontally movable (to the right and left in FIG. 14) manner. The first slide 114 supports the second slide 118 in a vertically movable manner. The first and second slides 114,118 constitute a slide mechanism 119. A guide roller mechanism 120 is attached to the second slide 118.

Figure 14:
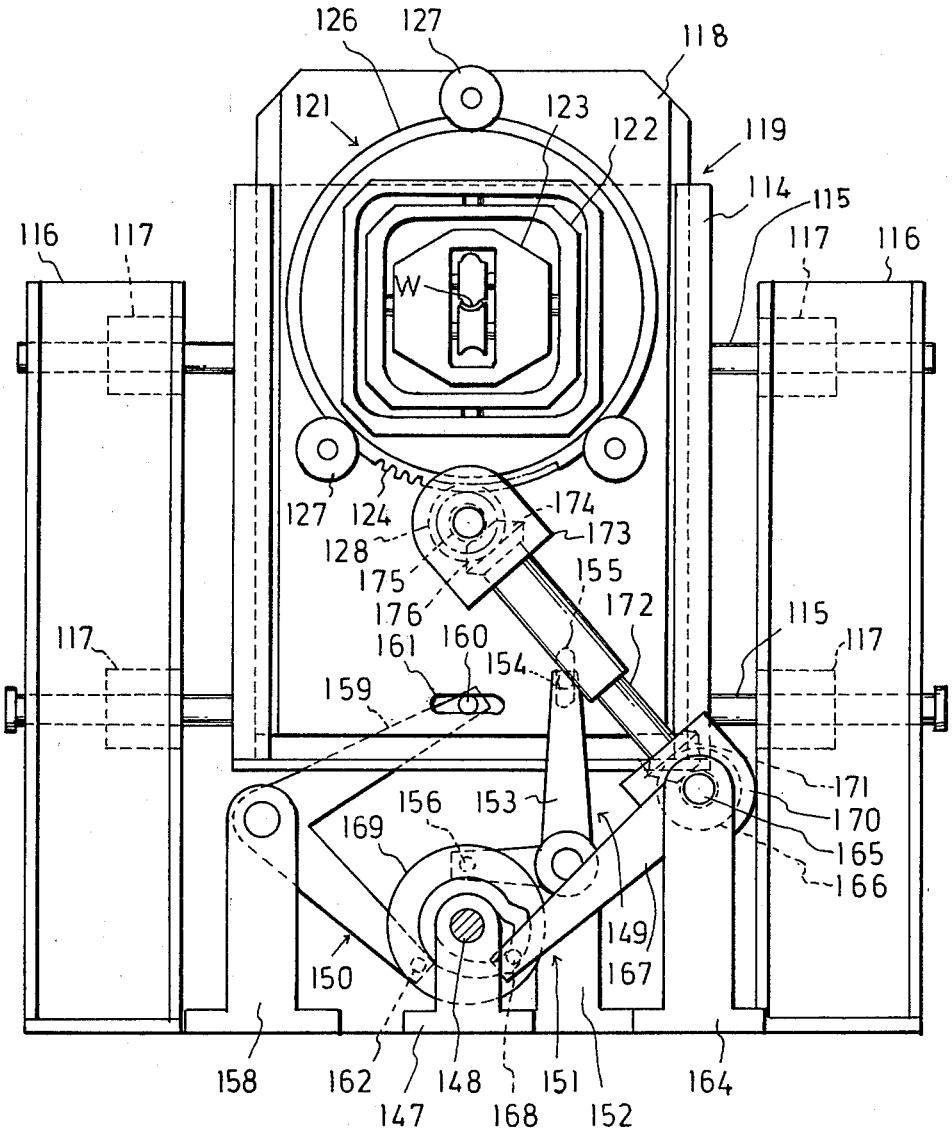
FIG. 14 is an enlarged elevational view of a movable guide roller device of the apparatus of FIG. 12.

The guide roller mechanism 120 includes the second guide roller element 123 installed at the center of a rotary mechanism 121 by means of a universal joint mechanism 122. The rotary mechanism 121 includes a rotary wheel 126 which has a periphery 125 provided with teeth 124 at the lower portion thereof and shaped in an angular manner. As shown in FIG. 14, the rotary wheel 126 is supported at the periphery 125 thereof by a plurality of rollers 127,127,127 located at the front side of the first slide 114 and having V-channels. A pinion 128 is supported on the second slide 118, and adapted to engage with the teeth 124 of the rotary wheel 126 to rotate the wheel 126. The universal joint mechanism 122 comprises an outer frame 130 attached with the same center as the rotary wheel 126 in front of the wheel 126 by a plurality of screws 131 and an inner frame 132 attached to the outer frame 130 by upper and lower vertically-extending pins 133,133 which intersect the axis of the rotary wheel 126 by an imaginery line connecting the pins 133,133. Pins 134,134 extend horizontally through the inner frame 132 at the right and left sides of the frame 132, and fixes the second guide roller element 123 within the inner frame 132.

The second guide roller element 123 includes a roller case 137 which is provided with a cavity 138 located at the center of the case 137. The roller case 37 also includes upper and lower shafts 136,136 supporting a pair of upper and lower rollers 135,135', respectively, in the cavity 138. A space 139 is provided between the upper and lower rollers 135,135', and has a similar shape as the cross section of the material W to be bent. The first guide roller element 113 has a similar shape as the second guide roller element 123. The roller case 137 of the second guide roller element 123 is attached to the inner frame 132 of the universal joint mechanism 122 by means of the pins 134. The center of the space 139 between the upper and lower rollers 135,135' is located at the intersection of two imaginery lines connecting the upper and lower pins 133,133 and right and and left pins 134,134, respectively.

The movable guide roller device 102 is connected to the material feed device 101 through a mechanical control device 140. An input portion, i.e., cam shaft 148 of the control device 140 is connected to a material feed roller 105 through a material-feed-amount detecting element. That is, the cam shaft 148 (supported on a bearing 147) of the control device 140 is connected in a rotatable manner to an output shaft 145 of a stepless speed variator 143 through a chain-transmission mechanism 146. The stepless speed variator 143 is provided with an operating shaft 142 for adjusting the change of speed, and also has an input shaft 144 connected to the intermediate shaft 109 through a chain-transmission mechanism 141 in a rotatable manner. The cam shaft 148 of the control device 140 also has mechanical connections with a cam mechanism 149 for controlling the first slide 114, cam mechanism 150 for controlling the second slide 118 and cam mechanism 151 for controlling the rotary wheel 126.

Figure 12:
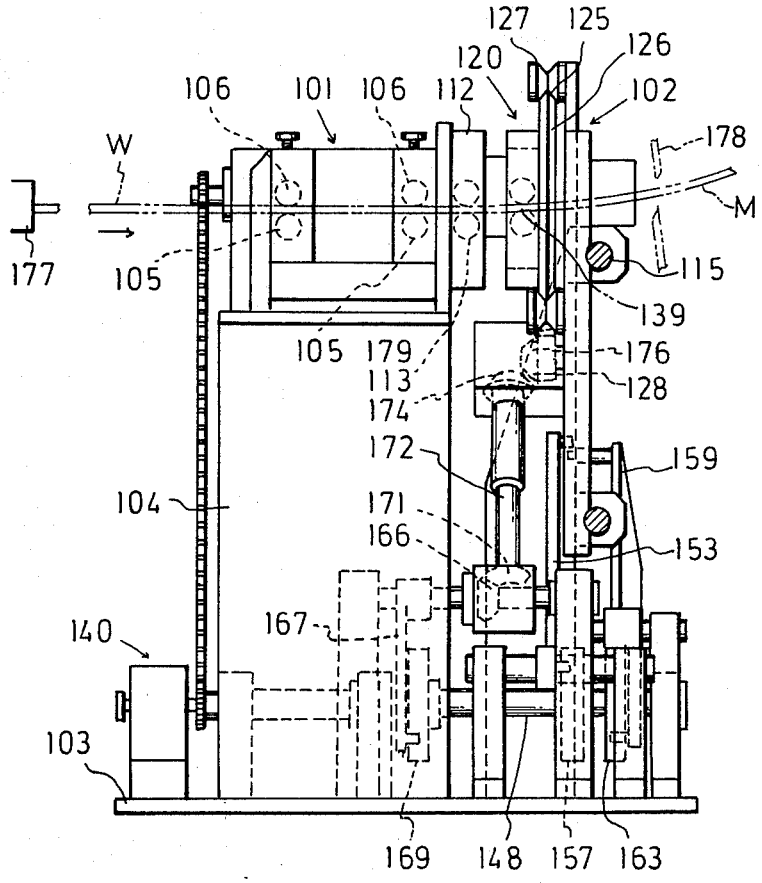
FIG. 12 is a partially-cutaway side view of another embodiment (lace bending apparatus) of the invention.
Figure 13:
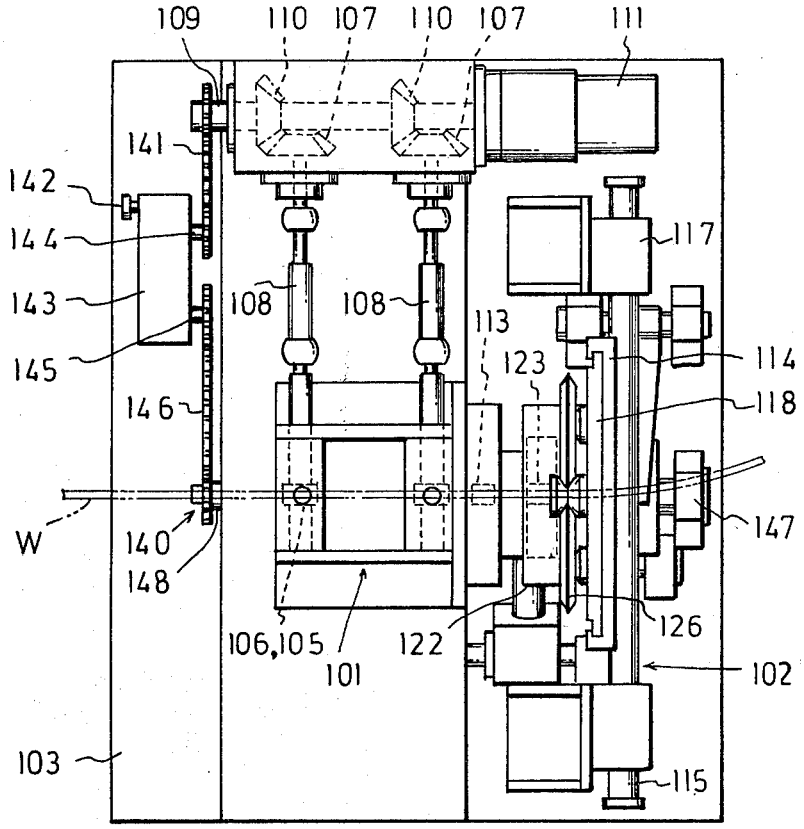
FIG. 13 is a plan view of the apparatus of FIG. 12.
Figure 15:
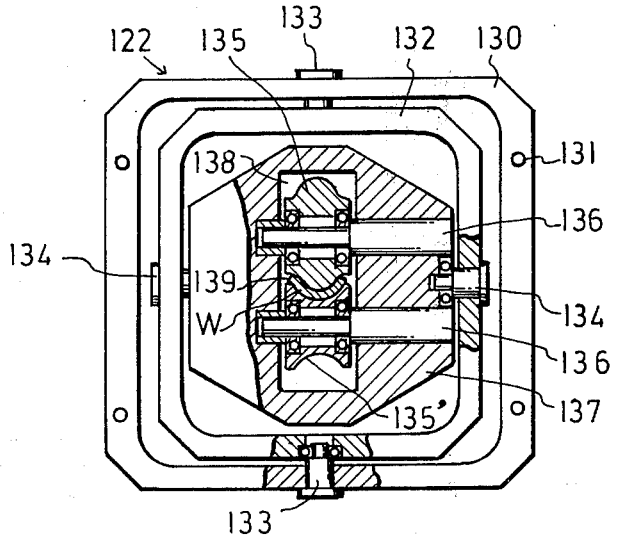
FIG. 15 is an enlarged cross sectional view showing the relationship between guide roller elements and a universal joint mechanism of the apparatus of FIG. 12.

The cam mechanism 149 for controlling the first slide 114 includes a lever 153 connected pivotally to a fixed element 151 and having a pin 154 at one end and a roller 156 at the other end. The pin 154 of the lever 153 is inserted into a hole 155 extending vertically in the first slide 114, while the roller 156 of the lever 153 is also inserted into a cam channel of the first channel-shaped control cam 157 attached to a cam shaft 148. The cam mechanism 150 for controlling the second slide 118 includes a lever 159 connected pivotally to a fixed element 158 and having a pin 160 at one end and a roller 162 at the other end. The pin 160 of the lever 159 is inserted into a hole 161 extending horizontally in the second slide 118, while the roller 162 of the lever 159 is also inserted into a cam channel of the second channel-shaped control cam 163 attached to the cam shaft 148. The cam mechanism 151 for controlling the rotary wheel 126 includes a support shaft 165 supported on a bearing element 164 and having a bevel gear 166 and a lever 167 having a roller 168 at one end. The roller 168 of the lever 167 is inserted into a cam channel of the third channel-shaped cam 169 for controlling the rotary wheel 126. The bevel gear 166 is engaged with a bevel gear 173 enclosed by a case 171 and connected to a bevel gear 174 by means of an expansion joint 172. The bevel gear 174 is enclosed by a case 173 which also encloses the pinion 128 having a bevel gear 176 engaged with the bevel gear 174. The case 170 is supported by the support shaft 165, while the case 173 is supported by the support shaft 165, while the case 173 is supported by a shaft 175 of the pinion 128. In FIG. 12, numerals 177 and 178 designate a forming machine provided in front of the material feed device 101 and a cutter located to the rear of the movable guide roller device 102, respectively.

Explanation is then given to the operation of this second embodiment of the invention. The material W having a desired cross section is produced in a linear manner by the forming machine 177. The material W is caused to enter the material feed device 101, moved backwardly by and through between the feed rollers 106,106 and support rollers 105,105, and caused to pass through a space 179 between upper and lower rollers of the (fixed) first guide roller element 113 and the space 139 between the upper and lower rollers 135,135' of the (movable) second guide roller element 123. In this condition (i.e., the material W being located between the feed rollers 106,106 and support rollers 105,105 and through the spaces 179 and 139 of the first and second guide roller elements 113 and 123), the feed motor 111 is operated to rotate the intermediate shaft 109 connected to the motor 111. This rotation of the intermediate shaft 109 is transmitted through the bevel gears 110,110 and 107,107 and universal joints 108,108 to the feed rollers 106,106 which are then rotated counterclockwise (in FIG. 12), causing the material W to move backward (to the right in FIG. 12). This rotation of the shaft 109 is simultaneously transmitted through the chain-transmission mechanism 141, stepless speed variator 143 and chain-transmission mechanism 146 to the cam shaft 148, which then causes the control cams 157, 163 and 169 to rotate in accordance with the feed amount of the material W. The speed change of the stepless speed variator 143 has previously been adjusted by the operating shaft thereof so that the cam shaft finishes one rotation when the feed amount of the material W has reached the predetermined length of a product to be obtained.

The rotation of the second control cam 163 causes the lever 159 of the cam mechanism 159 to move in a pivotal manner so that the second slide 118 moves vertically by the predetermined amount, causing the second guide roller element 123 (through the rotary wheel 126 and universal joint mechanism 122 connected to the wheel 126) to move vertically in relation to the (fixed) first guide roller element 113. Similarly, the rotation of the first control cam 157 causes the lever 153 of the cam mechanism 149 to move in a pivotal manner so that the first slide 14 moves horizontally (to the right and left in FIG. 14) by the predetermined amount, causing the second guide roller element 123 (through the rotary wheel 126 and universal joint mechanism 122 connected to the wheel 126) to move horizontally (to the right and left in FIG. 14). The rotation of the third control cam 169 causes the lever 167 of the cam mechanism 151 to move in a pivotal manner, and the movement of the lever 167 causes the bevel gear 166 to rotate. The rotation of the bevel gear 166 is transmitted through the bevel gear 171 engaged with the gear 166, the expansion joint 172, the bevel gear 174 provided at the upper end of the joint 172, the bevel gear 176 of the pinion 128, and the lower teeth 124 of the rotary wheel 126 so that the rotary wheel 126 is rotated, causing the second guide roller element 123 (through the universal joint mechanism 122) to rotate by the predetermined amount with the same axis of the rotary wheel 126.

These vertical, horizontal and turning movements of the second guide roller element 123 cause the material W (while being moved backwardly) to be bent in accordance with the predetermined radius of curvature and twisted as required between the (fixed) first guide roller element 113 and the (movable) second guide roller element 123.

The second guide roller element 123 can be freely inclined backward and forward (to the right and left in FIG. 12) by the pins 133,134 of the universal joint mechanism 122 so that the material W controls the posture of the second guide roller element 123 automatically in the moving direction of the material W when passing through the space 139 between the rollers 135 and 135' of the element 123. Therefore, the material W can pass smoothly through the space 139. When the material W passing through the space 139 has reached the predetermined length, a command from the cam shaft 148 is given to the cutter 178, which then cuts the material W to produce a lace product M (FIG. 12).

Figure 16:
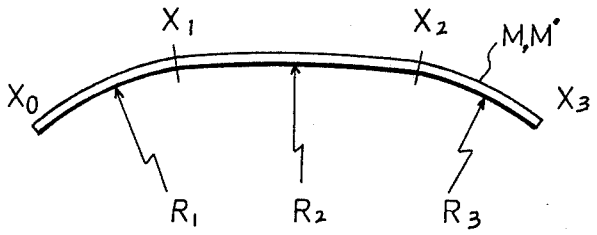
FIG. 16 shows a product bent by using the apparatus of FIG. 12.
Figure 17:
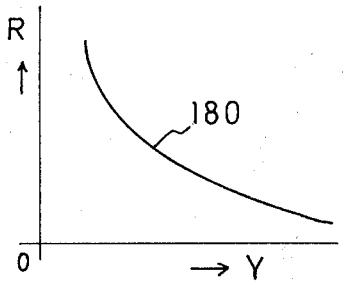
FIG. 17 is a graph showing the relationship between the radius of curvature of materials and the removal amount of slides.
Figure 18:
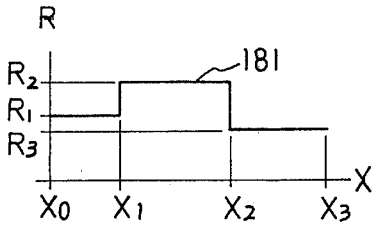
FIG. 18 shows a size program.
Figure 19:
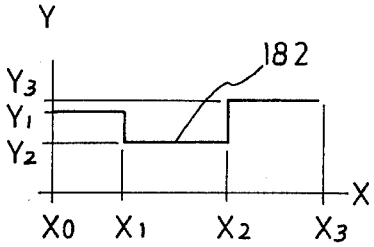
FIG. 19 shows XY program.
Figure 20:
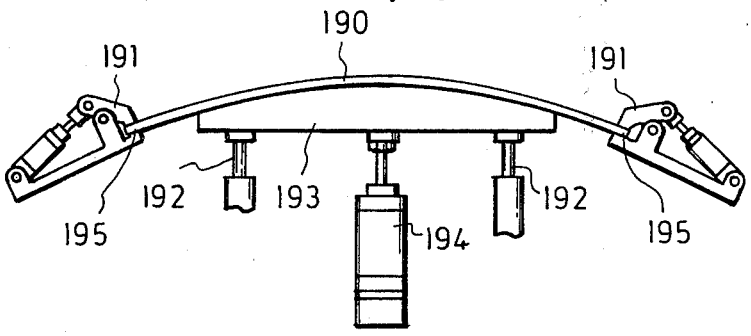
FIG. 20 is an elevational view of the conventional bending apparatus.

Explanation is then given to the procedure for the production of the control cams 157, 163 and 169. For simplicity of explanation, it is assumed that the product M to be obtained from the material W must be given the curvature radii of $R_1$, $R_2$ and $R_3$ between values $X_0$ and $X_1$, $X_1$ and $X_2$, and $X_2$ and $X_3$, respectively, in the lengthwise direction of the material W. A diagram M' of FIG. 16 shows such product to be obtained. The material W fed from the material feed device 101 and first guide roller element 113, when passing through the space 139 in the second guide roller element 123, is bent on trial by moving the first slide 114 gradually by appropriate values. By this trial bending, curve data 180 is obtained as to the correlation between the curvature radius R of the material W and the moving amount Y of the first slide 114 (FIG. 17). Secondly, a program 181 (FIG. 18) is obtained as to the correlation between the feed amount X and curvature radius R of the material W, based on the diagram M'. The last step is made by obtaining a X-Y program 182 (FIG. 19) comprising converted curvature radii $R_1$, $R_2$ and $R_3$ and moving amounts $Y_1$, $Y_2$ and $Y_3$ from the data 180 and X-Y program 181. Based on the X-Y program 182, the control cam 157 suitable for a desired bending of the material W can be formed in the conventional manner. The other cams 163 and 169 can be formed in the same manner as above.

As many apparently widely different embodiments of this invention may be made without departing from the spirit and scope thereof, it is to be understood that the invention is not limited to the specific embodiments thereof except as defined in the appended claims.

What is claimed is:

1. A lace bending apparatus comprising:

a. a material feed device for supplying a material in the lengthwise direction thereof, b. a first guide roller element provided fixedly on the side to receive said material supplied from said material feed device and adapted to locate said material, c. a support mechanism including a plurality of frames provided fixedly on the side to receive said material supplied from said first guide roller element and a movable element mounted to move in directions perpendicular to the direction of supply of said material from said first guide roller element, d. a second guide roller element provided in said movable element and adapted to bend said material, e. means to maintain said second guide roller element substantially at right angles to the direction of feed of said material, f. a plurality of driving means connected to said movable element for moving said movable element in said perpendicular directions, g. a means connected to said material feed device for detecting the amount of feed of said material by said material feed device, and h. a control device responsive to information from said feed-amount detecting means for controlling said driving means, including an input portion adapted to receive the feed amount information from said detecting means, a memory portion for storing in advance the relationship between the feed amount of said material and the moving amount of said movable element, and a command portion adapted to designate driving amounts of said driving means based on said relationship stored in said memory portion, in accordance with said information from said input portion, wherein said movable element includes a first slide provided movable in the horizontal direction perpendicular to the direction of supply of said material from said first guide roller element and a second slide provided movable in a vertical direction, said driving means includes a first-slide driving element connected to said first slide for moving said first slide in said horizontal direction and a second-slide driving element connected to said second slide for moving said second slide in a vertical direction, and said memory portion of said control device includes a first memory means storing in advance the relationship between the amount of feed of said material and the moving amount of said first slide and a second memory means storing in advance the relationship between the amount of feed of said material and the moving amount of said second slide and wherein said command portion of said control device includes a first command means responsive to information from said input portion for designating a moving amount to said first-slide driving element based on the relationship stored in advance into said first memory means and a second command means responsive to information from said input portion for designating a moving amount to said second-slide driving element based on the relationship stored in advance into said second memory means.

2. A lace bending apparatus in accordance with claim 1 wherein said movable element further includes a rotary means adapted to effect angular movements in the plane perpendicular to the direction of supply of said material from said first guide roller element and supporting said second guide roller element, said driving means further include a driving element connected to said rotary means for rotating said rotary means, said memory portion of said control device further includes a third memory means for storing in advance the relationship between the amount of feed of said material and the amount of angular movement of said rotary means, and said command portion of said control device further includes a third command means responsive to information from said input portion for designating a moving amount to said driving element (for rotating said rotary means) based on said relationship stored in advance into said third memory means.

3. A lace bending apparatus in accordance with claim 2 wherein said movable element further includes a universal joint mechanism provided on said rotary means, said second guide roller element being provided in said universal joint mechanism.

4. A lace bending apparatus in accordance with claim 2 or 3 wherein said material feed device includes a plurality of material-feed rollers, said feed-amount detecting means comprises an oscillator responsive to said feed rollers for making electric signals in accordance with the rotation of said feed rollers, said first-slide driving element comprises a first electric motor and a ball-screw mechanism connecting said first electric motor and said first slide, said second driving element comprises a second electric motor and a ball-screw mechanism connecting said second electric motor and said second slide, said rotary-means-driving element comprises a third electric motor and said rotary means, and said control device comprises an electric circuit.

5. A lace bending apparatus in accordance with claim 2 or 3 wherein said material feed device includes a plurality of material-feed rollers, said input portion of said control device comprises a cam shaft, first, second and third grooved cams, respectively, attached to said cam shaft, said first, second and third command means of said control device comprises grooves formed in said first, second and third cams, respectively, said material-feed-amount detecting means comprises a mechanism connecting said material-feed rollers and said cam shaft, said first-slide driving element comprises a mechanism connecting the groove of said first cam and said first slide, said second-slide driving element comprises a mechanism connecting the groove of said second cam and said second slide, and said rotary-mean-driving element comprises a mechanism connecting the groove of said third cam and said rotary means.

* * * * *